US007150661B2

(12) United States Patent
Cisey

(10) Patent No.: US 7,150,661 B2
(45) Date of Patent: Dec. 19, 2006

(54) ELECTRICAL AND MECHANICAL CONNECTING DEVICE FOR AN ELECTRICAL CONNECTION UNIT

(75) Inventor: Johann Cisey, Saint Symphorien d'Ancelles (FR)

(73) Assignee: ABB Entrelec, Villeurbanne (FR)

( * ) Notice: Subject to any disclaimer, the term of this patent is extended or adjusted under 35 U.S.C. 154(b) by 0 days.

(21) Appl. No.: 11/235,126

(22) Filed: Sep. 27, 2005

(65) Prior Publication Data

US 2006/0073742 A1 Apr. 6, 2006

(30) Foreign Application Priority Data

Oct. 1, 2004 (FR) ..... 04 10408

(51) Int. Cl.
*H01R 11/22* (2006.01)

(52) U.S. Cl. ..... 439/857

(58) Field of Classification Search ..... 439/94, 439/716, 856–859, 92, 95, 830, 834, 854, 439/861, 879

See application file for complete search history.

(56) References Cited

U.S. PATENT DOCUMENTS 4,113,982 A * 9/1978 Glaesel ..... 174/158 R
5,022,873 A * 6/1991 Kollmann ..... 439/716
6,106,310 A 8/2000 Davis et al.
2004/0152367 A1* 8/2004 Conrad ..... 439/716

FOREIGN PATENT DOCUMENTS

DE 87 11 525 U1 10/1987
DE 101 12 259 A1 9/2001
FR 2 694 141 A 1/1994
FR 2 828 020 A 1/2003

* cited by examiner

*Primary Examiner*—Ross Gushi
(74) *Attorney, Agent, or Firm*—Oliff & Berridge, PLC

(57) ABSTRACT

Electrical and mechanical connecting device designed to be connected to a connection unit, including at least two fixing branches, at least one of these branches being elastic, each including at its end means of fixing to a connection unit, at least a first mechanical bearing point bearing against the connection unit, situated between the ends including the fixing means of the two branches, a second bearing point promoting the electrical contact between the connection unit and the device, also situated between the ends including the fixing means of the two branches, and the means of connection to an external conductive component.

15 Claims, 2 Drawing Sheets

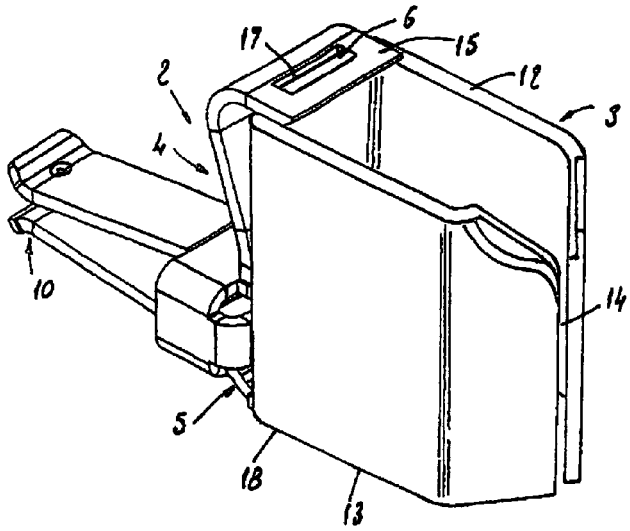
FIG 1
FIG 2
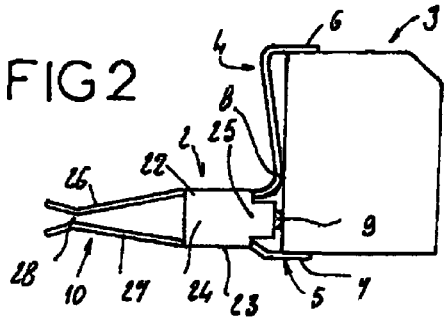
FIG 3
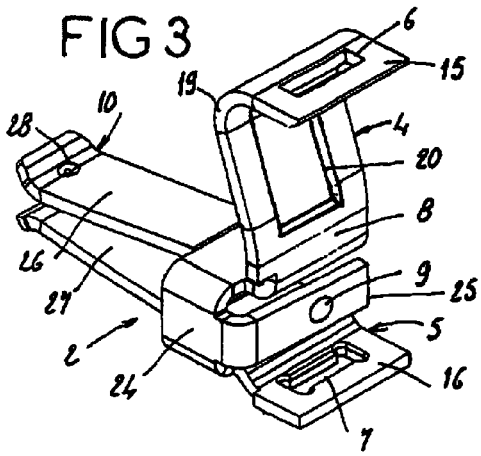
FIG 4
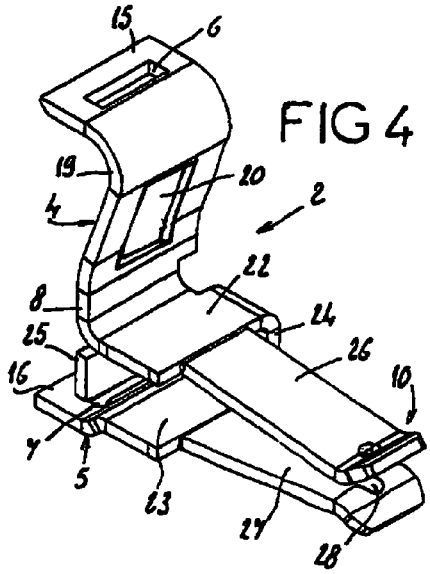

ELECTRICAL AND MECHANICAL CONNECTING DEVICE FOR AN ELECTRICAL CONNECTION UNIT

BACKGROUND OF THE INVENTION

The present invention relates to a mechanical and electrical connecting device intended in particular for connecting an electrical connection unit such as a clip, an insulation displacement grip, a terminal associated with a wire clamp, etc.

DESCRIPTION OF THE PRIOR ART

A conductor wire can be connected in a number of ways using a connection piece. Particularly well known in the art is the use of a connection grip, which includes two portions or branches designed to grip the conductive core of the wire.

It is, of course, necessary to make the connection between such a grip and the other electrical components of a circuit, and in particular with a conductive strip situated in a junction block. The electrical and mechanical contact must be maintained tightly between the connection grip and the connecting device to allow sufficient current to flow.

To this end, fixing the connecting device to the grip by rivets, by welding, or even by pushing back are known in the art.

Fixing the connecting device to the grip therefore requires the use of a tool, which makes the assembly of these two elements more complicated.

Producing the grip and the connecting device in a single piece is also known in the art.

There are types of connection grip, in particular the connection grips intended for insulation-displacement devices, which are produced in materials of high rigidity and high mechanical strength, so that the grip can both cut through the insulation of a conductor wire and hold the core of the conductor wire in position.

For grips of such hardness, it is detrimental to produce the connecting device in a single piece with the grip, because working and cutting the connecting device in a hard material is difficult and costly.

The object of the present invention is therefore to provide a connecting device, in particular for a connection grip, for which the fixing to the grip can be made without special tools, which guarantees sufficient mechanical and electrical contact for a given current to flow, and which can be used with an extremely hard connection grip.

SUMMARY OF THE INVENTION

To this end, the subject of the present invention is an electrical and mechanical connecting device for connecting a connection unit, which includes:

- at least two fixing branches, at least one of these branches being elastic, each including at its end means of fixing to a connection grip,
- at least a first mechanical bearing point bearing against the connection grip, situated between the ends including the fixing means of the two branches,
- a second bearing point promoting the electrical contact between the grip and the connecting device, also situated between the ends including the fixing means of the two branches, and
- means of connection to an external conductive component.

The presence of an elastic branch means that the connecting device can be mounted on the grip without distorting the clip, then the two fixing points formed at the ends of the fixing branches together with the first bearing point ensure that the unit is held in position on the grip. The electrical bearing point is not subject to great mechanical stresses and can therefore be of a shape suited to establishing an electrical contact.

Advantageously, the second bearing point is associated with elastic securing means in contact with the grip.

According to one embodiment, at least one of the elastic link branches presents a bend, the inside of which is oriented towards the grip.

Advantageously, the first mechanical bearing point is located at the end of an elastic fixing branch opposite its end including the fixing means, and separated from the latter by a bend.

According to one embodiment, first and second fixing branches are extended by two portions situated in a plane roughly perpendicular to an axis passing through the ends of the two branches including the fixing means, these two extension portions being linked by at least one lateral material bridge, situated in a plane roughly parallel to an axis passing through the ends of the two branches including the fixing means.

Advantageously, the second bearing point promoting the electrical contact is situated on an elastic tab linked to the material bridge connecting the fixing branches.

According to one embodiment, the electrical bearing point includes a boss promoting the electrical contact.

Advantageously, the means of fixing to the connection unit include openings provided near the end of at least one of the branches, the connection unit including at least one tab designed to be inserted into said opening.

According to one embodiment, the means of fixing to the connection unit are formed by openings provided respectively near the end of two fixing branches, in end portions of these branches opposite one another, the connection unit including a tab opposite each of these openings, into which it is designed to be inserted, the tabs being directed in two opposing directions.

Advantageously, the connection means are formed by two extended portions forming a connecting grip for a conductive strip.

According to one embodiment, the extended portions are formed by prolonging the portions prolonging the fixing branches.

Advantageously, the connection means are formed by a tab designed to cooperate with a connecting grip.

According to one embodiment, at least one of the fixing branches includes an opening, in particular longitudinal, reinforcing its elasticity.

Advantageously, the connecting device comprises two fixing branches, a first elastic branch and a second nonelastic branch.

According to one embodiment, the connecting device is produced in a single piece.

In any case, the invention will be clearly understood from the description that follows, with reference to the appended drawing, representing, in a nonlimiting way, several embodiments of the connecting device according to the invention, in the case of its connection to a connection grip.

BRIEF DESCRIPTION OF THE DRAWINGS

FIG. 1 is a perspective view of it according to a first embodiment, mounted on a connection grip.

FIG. 2 is a side view of the unit of FIG. 1, mounted on a connection grip.

FIG. 3 is a perspective view of the device of FIG. 1 on its own.

FIG. 4 is a perspective view of it from a different angle.

DESCRIPTION OF THE PREFERRED EMBODIMENTS

Figure 5:
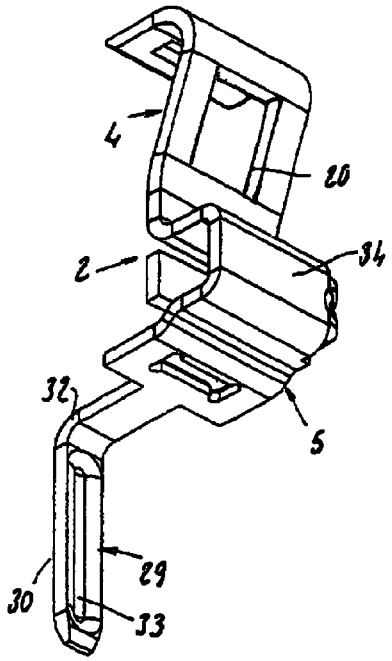
FIG. 5 is a perspective view of a second embodiment of the connecting device.

According to a first embodiment, shown in FIGS. 1 to 4, an electrical and mechanical connecting device 2 according to the invention, designed in particular for connecting a connection grip 3, comprises:

first 4 and second 5 fixing branches, the first branch 4 being elastic, each including, at its end, means of fixing 6, 7 to the connection grip 3, a first mechanical bearing point 8 bearing against the connection grip 3, situated between the fixing ends of the two branches 4 and 5, a second bearing point 9 promoting the electrical contact between the grip 3 and the device 2, also situated between the fixing ends of the two branches 4 and 5, and means of connection 10 to a conductive strip not shown.

This device 2 is produced in a single piece.

The grip 3 includes, in a manner known in the art, a roughly tubular body of polygonal section presenting, between its two end edges 12, 13, a longitudinal connection slot 14 over its entire length.

The means of fixing 6, 7 to the grip 3 are formed by two openings respectively provided near the end of each of the fixing branches 4, 5, in two end portions 15, 16 of these branches roughly parallel to each other, the grip 3 including, opposite each of these openings, on each of its end edges 12, 13, a tab 17, 18 of a shape roughly complementing the opening into which it is designed to be inserted, the tabs 17 and 18 being directed in two opposing directions.

The first fixing branch 4 presents a bend 19, the inside of which is oriented towards the grip 3, the first mechanical bearing point 6 being situated at the end of the first fixing branch 4 opposite its end including the fixing means 6, and separated from the latter by the bend 19.

The first fixing branch 4 includes a longitudinal opening 20, reinforcing its elasticity.

The second branch 5 is shorter than the first and presents no bend similar to that of the first branch.

The first 4 and the second 5 fixing branches are extended by two portions 22, 23, roughly parallel, and perpendicular to the wall of the grip 3, and with an axis passing through the fixing points 6, 7 of the two branches 4 and 5, the two extension portions 22, 23 being linked by a lateral material bridge 24, situated in a plane parallel to the axis passing through the fixing points of the two branches 4 and 5.

The second bearing point 9 promoting the electrical contact is situated on an elastic tab 25 linked to the material bridge 24 connecting the fixing branches by one of its ends, the tab 25 presenting an elasticity to ensure contact with the grip 3.

The second electrical bearing point 9 includes a boss promoting the electrical contact.

The means of connection 10 to a conductive strip are formed by two extended portions 26, 27 formed by extending the extension portions 22, 23.

These two portions 26, 27 converge towards one another then diverge, providing a space between them, so forming an elastic clip for the strip.

The two portions present, at their nearest point, a boss 28 promoting the electrical contact with this strip.

Figure 6:
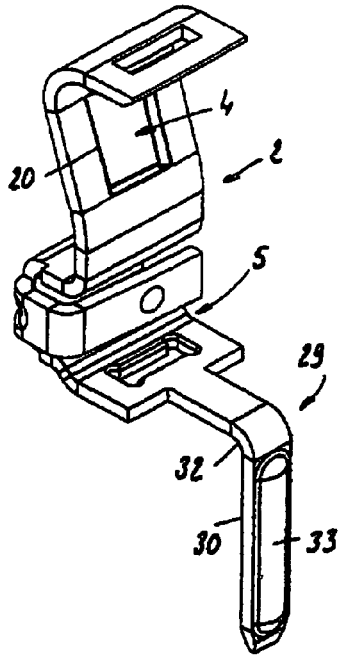
FIG. 6 is a perspective view of the device of FIG. 5 from a different angle.

According to a second embodiment, shown in FIGS. 5 and 6, the connecting device includes the same elements with the same references as in the first embodiment, apart from those described below.

The connection means 29 are formed in this embodiment by a tab 30 prolonging the second fixing branch by forming a bend 32 and designed to cooperate with a connecting device not shown.

The end part of this tab, oriented parallel to the wall of the connection grip 3, in a direction opposite the latter relative to the bend 32, includes a boss 33 promoting the electrical contact with the connecting device not shown.

Also, the material bridge 34 linking the extension portions is situated in a plane parallel to the wall of the connection grip 3, prolonging the branches 4 and 5 and not laterally as in the first embodiment.

Figure 7:
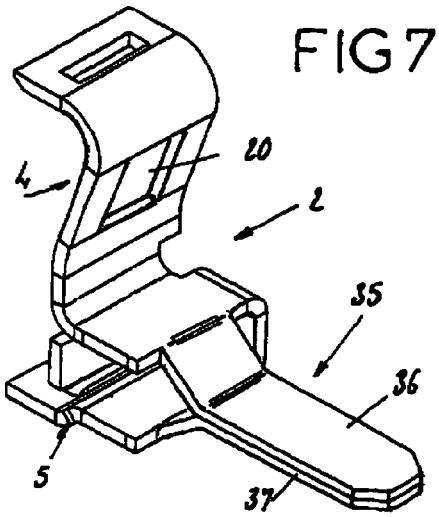
FIG. 7 is a side view of a third embodiment of the connecting device.

According to a third embodiment, shown in FIG. 7, the connecting device includes the same elements with the same references as in the first embodiment, apart from those described below.

The means of connection 35 to a conductive strip are formed by two extended portions 36, 37 formed by extending the extension portions 22, 23.

These two portions 36, 37 converge towards one another so as to be roughly in contact with each other to form a tab designed to cooperate with a connecting device not shown.

It goes without saying that the invention is not limited to the preferred embodiment described above, by way of nonlimiting examples; in fact it embraces all the variant embodiments within the framework of the claims below.

Thus, it is possible to produce fixing means in which the openings are provided on the grip and the tabs are provided on the fixing branches.

Furthermore, as indicated previously, the connection unit could be other than a grip.

The invention claimed is:

1. An electrical and mechanical connecting device of a connection unit, which includes:

at least two fixing branches, at least one of these branches being elastic, each including, at its end, means of fixing to a connection unit, at least a first mechanical bearing point bearing against the connection unit, situated between the ends including the fixing means of the two branches, a second bearing point promoting the electrical contact between the connection unit and the connecting device, also situated between the ends including the fixing means of the two branches, means of connection to an external conductive component, and wherein the second bearing point promoting the electrical contact is situated on an elastic tab distinct from the at least two fixing branches.

2. The connecting device as claimed in claim 1, wherein the second bearing point is associated with elastic securing means in contact with the connection unit.

3. The connecting device as claimed in claim 1, wherein at least one of the elastic link branches presents a bend, the inside of which is oriented towards the connection unit.

4. The connecting device as claimed in claim 3, wherein the first mechanical bearing point is located at the end of an elastic fixing branch opposite its end including the fixing means, and separated from the latter by a bend.

5. The connecting device as claimed in claim 1, wherein first and second fixing branches are extended by two extension portions being linked by at least one lateral material bridge.

6. The connecting device as claimed in claim 5, wherein the elastic tab is linked to the material bridge.

7. The connecting device as claimed in claim 1, wherein the electrical bearing point includes a boss promoting the electrical contact.

8. The connecting device as claimed in one of claim to 7, wherein the means of fixing to the connection unit include openings provided near the end of at least one of the branches, the connection unit including at least one tab designed to be inserted into said opening.

9. The connecting device as claimed in claim 8, wherein the means of fixing to the connection unit are formed by openings provided respectively near the end of two fixing branches, in end portions of these branches opposite one another, the connection unit including a tab opposite each of these openings, into which it is designed to be inserted, the tabs being directed in two opposing directions.

10. The connecting device as claimed in claim 1, wherein the connection means are formed by two extended portions forming a connecting device for a conductive strip.

11. The connecting device as claimed in claim 10, wherein the extended portions are formed by prolonging the extension portions.

12. The connecting device as claimed in claim 1, wherein the connection means are formed by a tab designed to cooperate with a connecting device.

13. The connecting device as claimed in claim 1, wherein at least one of the fixing branches includes an opening, in particular longitudinal, reinforcing its elasticity.

14. The connecting device as claimed in claim 1, which includes two fixing branches, a first elastic branch and a second nonelastic branch.

15. The connecting device as claimed in claim 1, which is produced in a single piece.

* * * * *